United States Patent [19]

Bourne

[11] 4,365,831

[45] Dec. 28, 1982

[54] CHANNEL LATCH

[75] Inventor: William R. Bourne, Anaheim, Calif.

[73] Assignee: Hartwell Corporation, Placentia, Calif.

[21] Appl. No.: 137,555

[22] Filed: Apr. 4, 1980

[51] Int. Cl.[3] ..... E05C 3/02

[52] U.S. Cl. ..... 292/229; 292/210; 292/DIG. 31

[58] Field of Search ..... 292/229, 210, DIG. 31, 292/113, 209, 107, 152, 87, 86, 129

[56] References Cited

U.S. PATENT DOCUMENTS 1,173,399 2/1916 Van orden ..... 292/107

2,210,080 8/1940 Hover et al. ..... 292/DIG. 31 X 2,752,186 6/1956 Morrison ..... 292/DIG. 31 X 3,250,558 5/1966 McClintock ..... 292/DIG. 31 X

*Primary Examiner*—Richard E. Moore

*Attorney, Agent, or Firm*—Lyon & Lyon

[57] ABSTRACT

A latching mechanism including an engageable latch bolt and latch trigger each adapted to be pivoted from a first preselected position wherein the latch bolt and latch trigger are engaged to a second predetermined position where the latch bolt and the latch trigger are disengaged such disengagement being accomplished by actuation of a latch trigger actuator which overcomes an actuator biasing means which links the latch bolt and the latch trigger.

10 Claims, 5 Drawing Figures

CHANNEL LATCH

BACKGROUND OF THE INVENTION

The present invention relates to a latch assembly for use in applications where the latched surface is subjected to pressure and acceleration loading. The present invention is directed to providing a latch which resists inadvertent opening of the latch due to pressure and/or accelerational loading while also providing a latch mechanism that is easily opened when it is desired to do so.

SUMMARY OF THE INVENTION

A latching mechanism including an engageable latch bolt and a latch trigger each adapted to be pivoted from a first preselected position wherein the latch bolt and latch trigger are engaged and a second predetermined position where the latch bolt and the latch trigger are disengaged such disengagement being accomplished by actuation of a latch trigger actuator which overcomes an actuator biasing means which links the latch bolt and the latch trigger. The latch trigger includes a latch trigger biasing means positioned about the pivot of the latch trigger and the physical characteristics of the latch assembly are as set out below:

$$MB \geqq \frac{(M_T)(A_2)(X_2)}{(A_1)(X_1)} \text{ and } MB \geqq \frac{(M_T)(M_2)(X_2)}{(M_1)(X_1)}$$

where $M_B$=moment of latch trigger actuator biasing means $M_T$=moment of latch trigger means biasing means $A_2$=surface area of latch trigger actuator $X_2$=distance between the centerline of the latch trigger actuator and the center of the latch trigger biasing means anchor $A_1$=surface area of latch trigger means $X_1$=distance between the center line of the latch trigger actuator and the center of the latch trigger biasing means anchor $M_2$=mass of latch trigger actuator $M_1$=mass of latch trigger means

DESCRIPTION OF PREFERRED EMBODIMENT

Figure 5:
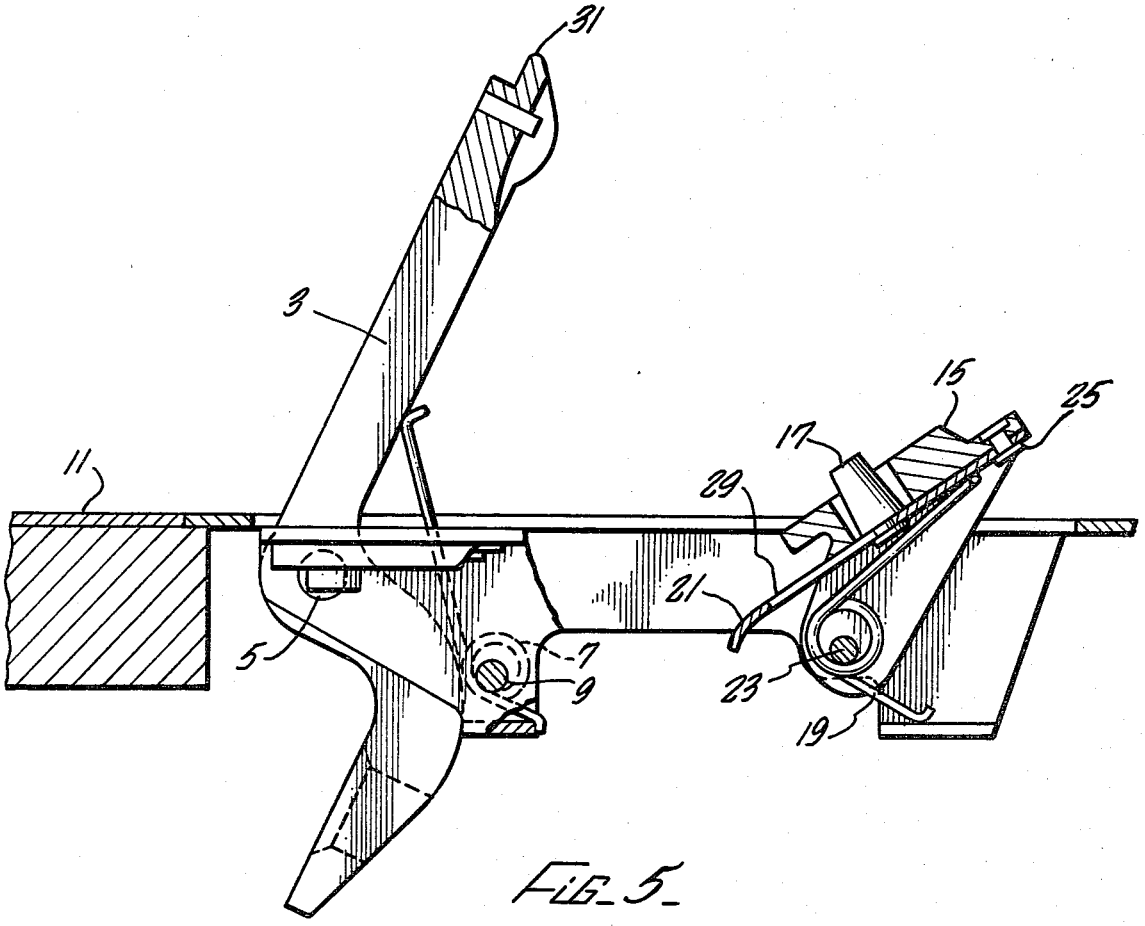
FIG. 5 is a side view in partial cross-section illustrating the present invention.

Referring to the drawings, and more specifically to FIG. 5, the preferred embodiments of the present invention will be discussed. A latch bolt means 3 is adapted to pivot about a fixed latch bolt means pivot 5. Latch bolt means biasing means 7, which is preferably a torsional spring, is positioned about a latch bolt means biasing means fixed anchor 9, the latch bolt means biasing means urging the latch bolt means to assume the disengaged second preselected position as illustrated in FIG. 5. The first preselected position for the latch bolt means

Figure 1:
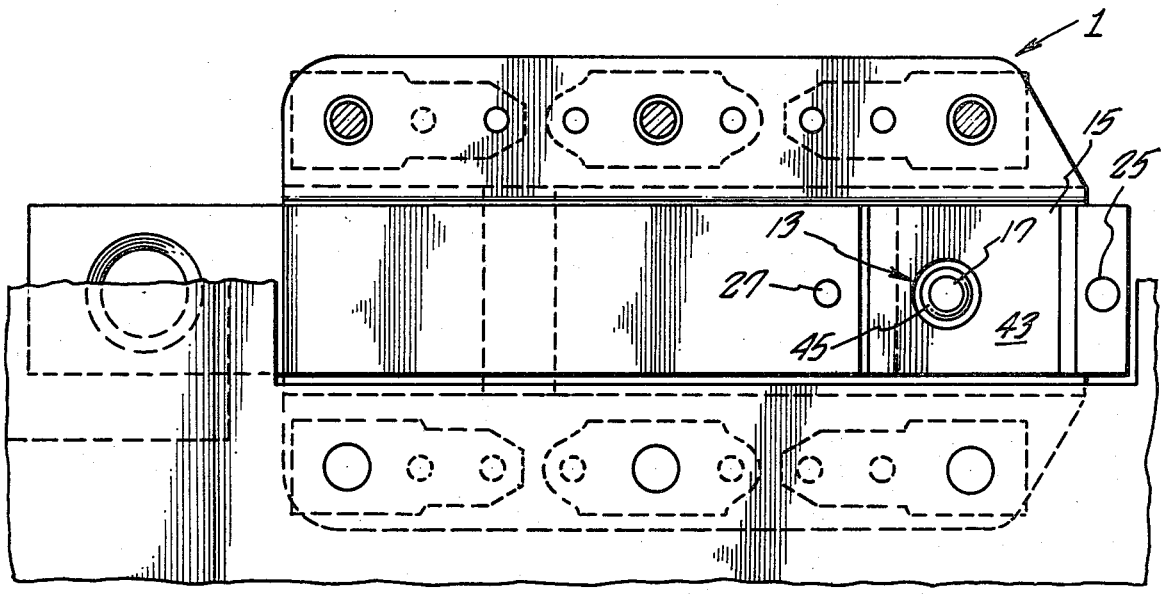
FIG. 1 is a top view illustrating the present invention.

3 is illustrated in FIG. 1 where the latch bolt means 3 lies on the same plane as the skin 11.

Figure 2:
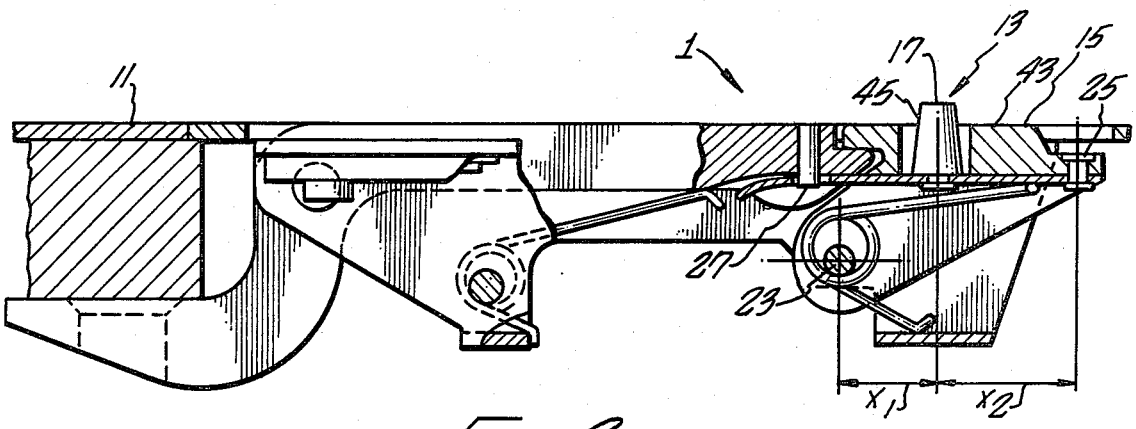
FIG. 2 is a side view in partial cross-section illustrating the present invention.

The latching mechanism of the present invention further includes a latch actuator assembly 13 including a latch trigger means 15 adapted for pivotal movement about latch trigger fixed pivot 23 and a latch trigger actuator 17. The latch trigger actuator 17 is secured to an actuator biasing means 21 which is preferably a leaf spring. The latch trigger actuator biasing means 21 is secured to the latch actuator assembly 13 at one end by actuator biasing means anchor 25. The latch trigger means 15 is urged to assume the second preselected latch trigger means position as illustrated in FIG. 5 by latch trigger means biasing means 19 which is preferably a torsional spring. FIG. 2 illustrates the first latch trigger means 15 and latch bolt means 3 preselected positions wherein the latch bolt means 3 and the latch trigger means 15 are engaged.

The latch trigger actuator biasing means 21 is preferably provided with an actuator biasing means aperature 29 for engagement with actuator biasing means catch 27 in order to link the latch bolt means 3 and the latch trigger means 15.

As illustrated in FIG. 2, $X_1$ represents the distance between the center line of the latch trigger actuator 17 and the center of the latch trigger means fixed pivot 23 while $X_2$ represents the distance between the center line of the latch trigger actuator 17 and the center of the latch trigger biasing means anchor 25.

The latch bolt means 3 is provided with a latch bolt means shoulder 39 and a latch bolt means protrusion 31 while the latch trigger means 15 is provided with a latch trigger means face 41 and a latch trigger means recess 33. When the latch bolt means 3 and the latch trigger means 15 are in the first preselected position as illustrated in FIG. 2, the latch bolt means protrusion 31 engages the latch trigger means recess 33. As the latch bolt means 3 moves or pivots from the second preselected position of FIG. 5 to the first preselected position in FIG. 2 the latch bolt means shoulder 39 engages the latch trigger means face 41 in order to urge the latch trigger means 15 to pivot toward the first preselected position of FIG. 2.

Preferably the resistivity or bias of the latch trigger actuator biasing means 21 and the latch trigger means biasing means 19 are as described in accordance with the physical parameters set out below:

$$MB \geqq \frac{(M_T)(A_2)(X_2)}{(A_1)(X_1)} \text{ and } MB \geqq \frac{(M_T)(M_2)(X_2)}{(M_1)(X_1)}$$

where $M_B$=moment of latch trigger actuator biasing means 21

$M_T$=moment of latch trigger means biasing means 19

$A_2$=surface area 45 of latch trigger actuator 17

$X_2$=distance between the centerline of the latch trigger actuator 17 and the center of the latch trigger biasing means anchor 25

$A_1$=surface area 43 of latch trigger means 15

$X_1$=distance between the center line of the latch trigger actuator 17 and the center of the latch trigger biasing means anchor 25

$M_2$=mass of latch trigger actuator 17

$M_1$=mass of latch trigger means 15

Such a configuration produces a latch mechanism wherein when the latch assembly 1 including the latch bolt means 3 and latch actuator assembly 13 are subjected to pressure or accelerational forces the latch assembly remains latched as is shown in FIG. 2, such forces acting upon the latch actuator assembly 13 being made up of the surface area 45 of the latch trigger actuator 17 and the surface area 43 of the latch trigger means 15 as shown in FIG. 1.

Figure 4:
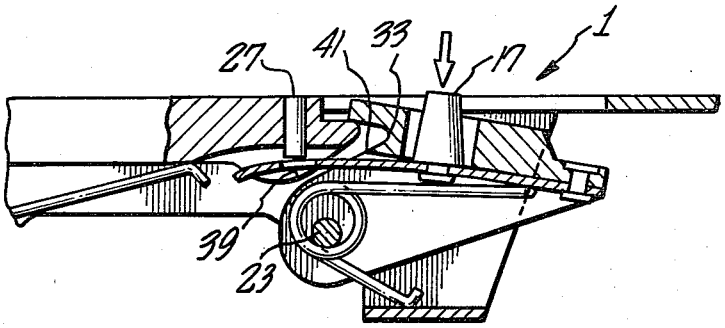
FIG. 4 is a side view in partial cross-section illustrating present invention.
Figure 3:
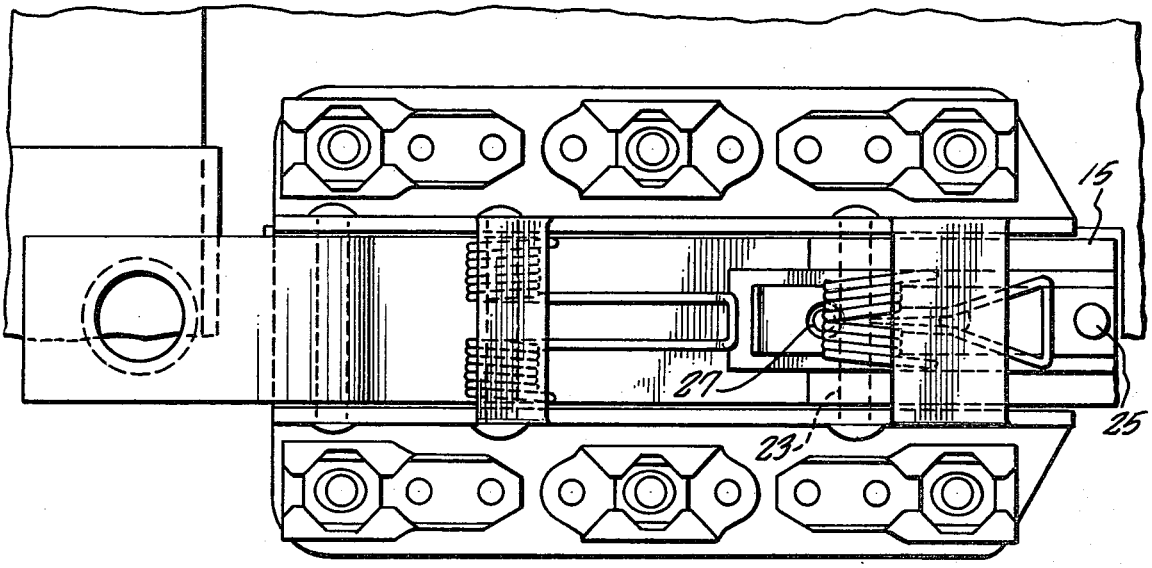
FIG. 3 is a bottom view illustrating the present invention.

As illustrated in FIG. 3, loading upon the surface area 43 of the latch trigger means 15 does not affect the linkage between the latch bolt means 3 and the latch trigger means 15 as effected by the actuator biasing means catch 27 and the latch trigger actuator biasing means 21. However, when the latch trigger actuator 17 is depressed the linkage between the bolt means 3 and the latch trigger means 15 is disengaged, as illustrated in FIG. 4, thus allowing both the latch bolt means 3 and the latch trigger means 15 to assume the second preselected position as illustrated in FIG. 5 as urged by the latch bolt means biasing means 7 and the latch trigger biasing means 19, respectively.

While the preferred embodiments and applications of the present invention have been shown and described, it would be apparent to those skilled in the art that other modifications were possible without parting from the inventive concepts herein described. Accordingly, the invention is not to be restricted excepted as is necessary by the spirit of the appended claims.

What is claimed is:

1. A latch assembly comprising:

a latch bolt means adapted for pivotal movement about a fixed latch bolt pivot;

latch trigger means adapted for pivotal movement and between at least first and second preselected latch trigger means positions, about a fixed latch trigger pivot, said latch trigger means including a latch trigger means engagement means and said latch bolt means including a latch bolt means engagement means for engaging said latch trigger means engagement means, said latch trigger means engagement means adapted for engaging said latch bolt means engagement means when said latch trigger means is at said first latch trigger means predetermined position and for disengaging said latch bolt means engagement means at said second latch trigger means predetermined position;

a latch actuator assembly including a latch trigger actuator biasing means operatively linking said latch bolt means and said latch trigger means and being anchored at one end to said latch actuator assembly and which urges engagement of said latch bolt means and said latch trigger means;

a latch trigger means biasing means positioned about said fixed latch trigger pivot for urging said latch trigger means to assume said first latch trigger means predetermined position; and a reciprocable latch trigger actuator connected to said latch trigger actuator biasing means for opposing the urging of such biasing means and for disengaging said latch bolt means and said latch trigger means upon reciprocation thereof.

2. The latch assembly claimed in claim 1 wherein said latch trigger actuator biasing means is further defined as a leaf spring.

3. The latch assembly claimed in claim 1 wherein said latch trigger actuator biasing means includes an aperature therein for engaging an actuator biasing means catch.

4. The latch assembly claimed in claim 1 further including a biasing means urging said latch bolt means to assume engagement with said latch trigger means.

5. The latch assembly claimed in claim 1 wherein the moment of the latch trigger actuator biasing means is at least equal to the ratio of the product of the moment of said latch trigger means biasing means, the surface area of said latch trigger actuator and the distance between the center line of said latch trigger actuator to the center of said latch trigger biasing means anchor to the product of the surface are of said latch trigger means and the distance between the center line of said latch trigger actuator to the center of said latch trigger means of said pivot.

6. The latch assembly claimed in claim 1 wherein the moment of the latch trigger actuator means is at least equal to the ratio of the product of the movement of said latch trigger means biasing means, the mass of said latch trigger actuator and the distance between the center line of said latch trigger actuator to the center of said latch trigger biasing means anchor to the product of the mass of said latch trigger means and the distance between the center line of said latch trigger actuator to the center of said latch trigger means fixed pivot.

7. The latch assembly claimed in claim 1 wherein said latch bolt means pivotal movement is further defined as between first and second preselected latch bolt means positions and said latch bolt means further includes a latch bolt means shoulder for engaging a latch trigger means face and urging said latch trigger means to rotate to said latch trigger means first position as said latch bolt means is rotated to said latch bolt means first position.

8. A latch assembly comprising:

a latch bolt means adapted for pivotal movement about a fixed latch bolt pivot;

latch trigger means adapted for pivotal movement and between at least first and second preselected latch trigger means positions, about a fixed latch trigger pivot, said latch trigger means including a latch trigger means engagement means and said latch bolt means including a latch bolt means engagement means for engaging said latch trigger means engagement means, said latch trigger means engagement means adapted for engaging said latch bolt means engagement means when said latch trigger means is at said first latch trigger means predetermined position and for disengaging said latch bolt means engagement means at said second latch trigger means predetermined position;

a latch actuator assembly including a latch trigger actuator biasing means operatively linking said latch bolt means and said latch trigger means and being anchored at one end to said latch actuator assembly and which urges engagement of said latch bolt means and said latch trigger means;

a latch trigger means biasing means positioned about said fixed latch trigger pivot for urging said latch trigger means to assume said first latch trigger means predetermined position; and a reciprocable latch trigger actuator connected to said latch trigger actuator biasing means for opposing the urging of such biasing means and disengaging said latch bolt means and said latch trigger means wherein the moment of the latch trigger actuator biasing means is at least equal to the ratio of the product of the moment of said latch trigger means biasing means, the surface area of said latch trigger actuator and the distance between the center line of said latch trigger actuator to the center of said latch trigger biasing means anchor to the product of the surface area of said latch trigger means and the distance between the center line of said latch trigger actuator to the center of said latch trigger means pivot.

9. The latch assembly claimed in claim 8 wherein the moment of the latch trigger actuator means is at least equal to the ratio of the product of the moment of said latch trigger means biasing means, the mass of said latch trigger actuator and the distance between the center line of said latch trigger actuator to the center of said latch trigger biasing means anchor to the product of the mass of said latch trigger means and the distance between the center line of said latch trigger actuator to the center of said latch trigger means pivot.

10. A latch assembly comprising:

a latch bolt means adapted for pivotal movement about a fixed latch bolt pivot;

latch trigger means adapted for pivotal movement and between at least first and second preselected latch trigger means positions, about a fixed latch trigger pivot, said latch trigger means including a latch trigger means engagement means and said latch bolt means including a latch bolt means engagement means for engaging said latch trigger means engagement means, said latch trigger means engagement means adapted for engaging said latch bolt means engagement means when said latch trigger means is at said first latch trigger means predetermined position and for disengaging said latch bolt means engagement means at said second latch trigger means predetermined position;

a latch actuator assembly including a latch trigger actuator biasing means operatively linking said latch bolt means and said latch trigger means and being anchored at one end to said latch actuator assembly and which urges engagement of said latch bolt means and said latch trigger means;

a latch trigger means biasing means positioned about said fixed latch trigger pivot for urging said latch trigger means to assume said first latch trigger means predetermined position; and a reciprocable latch trigger actuator connected to said latch trigger actuator biasing means for opposing the urging of such biasing means and disengaging said latch bolt means and said latch trigger means wherein the moment of the latch trigger actuator biasing means is at least equal to the ratio of the product of the moment of said latch trigger means biasing means, the surface area of said latch trigger actuator and the distance between the center line of said latch trigger actuator to the center of said latch trigger biasing means anchor to the product of the surface area of said latch trigger means and the distance between the center line of said latch trigger actuator to the center of said latch trigger means pivot and wherein the moment of the latch trigger actuator means is at least equal to the ratio of the product of the moment of said latch trigger means biasing means, the mass of said latch trigger actuator and the distance between the center line of said latch trigger actuator to the center of said latch trigger biasing means anchor to the product of the mass of said latch trigger means and the distance between the center line of said latch trigger actuator to the center of said latch trigger means of said pivot.

* * * * *